United States Patent [19]

Haugsjaa et al.

[11] 3,995,195

[45] Nov. 30, 1976

[54] ECCENTRIC TERMINATION FIXTURE FOR AN ELECTRODELESS LIGHT

[75] Inventors: Paul O. Haugsjaa, Acton; William McNeill, Carlisle; Robert J. Regan, Newton, all of Mass.

[73] Assignee: GTE Laboratories Incorporated, Waltham, Mass.

[22] Filed: Nov. 17, 1975

[21] Appl. No.: 632,416

[52] U.S. Cl. ..... 315/58; 315/248; 315/267; 313/151

[51] Int. Cl.[2] ..... H01J 61/56

[58] Field of Search ..... 315/55, 39, 58, 150, 315/59, 248, 267, 327, 328, 329, 330, 283, 284, 285, 286; 313/100, 146, 151, 198, 327

[56] References Cited

UNITED STATES PATENTS

| | | | |
|---|---|---|---|
| 2,432,488 | 12/1947 | Peacock et al. | 313/151 |
| 2,480,462 | 8/1949 | Garbe | 313/151 |
| 2,601,917 | 7/1952 | Lemaigre-Voreaux | 313/151 |
| 3,098,137 | 7/1963 | Cook | 313/151 |
| 3,826,950 | 7/1974 | Hruda et al. | 315/267 |
| 3,943,401 | 3/1976 | Haugsjaa et al. | 315/248 |
| 3,943,403 | 3/1976 | Haugsjaa et al. | 315/248 |

*Primary Examiner*—Alfred E. Smith
*Assistant Examiner*—Tommy P. Chin
*Attorney, Agent, or Firm*—Irving M. Kriegsman; Leslie J. Hart

[57] ABSTRACT

In a light source in which an electrodeless lamp is excited by high frequency power coupled into a lamp termination fixture having an inner and outer conductor, the fixture has a dynamically variable characteristic impedance, thereby facilitating dynamic matching of the variable impedance of the lamp during the lamp-off to lamp-run conditions to the output impedance of the power source. This feature is possible because the position of the inner conductor with respect to the outer conductor is controlled as a function of the heat generated within the fixture. The inner conductor is made of a conductive material having a non-uniform coefficient of thermal expansion. When the fixture is cold, the lamp and the lamp-coupled end of the inner conductor are substantially concentric to the outer conductor thereby creating a high characteristic impedance to match the high starting lamp impedance to the source impedance. When the lamp is running, the inner conductor and lamp become eccentric to the outer conductor due to the heat generated in the fixture, thereby reducing the fixture characteristic impedance to match the lower lamp impedance to the output impedance of the source.

7 Claims, 3 Drawing Figures

ECCENTRIC TERMINATION FIXTURE FOR AN ELECTRODELESS LIGHT

BACKGROUND OF THE INVENTION

The present invention relates to electrodeless light sources excited by high frequency power and, more specifically, to techniques and apparatus for optimizing the transfer of power from a source to the lamp.

Historically, there have been three methods of exciting discharges with electrodes. The first uses the discharge as a lossy part of either the capacitance or inductance of a tank circuit. A second method is to place the lamp in the path of radiation from a directional antenna. A third method uses a resonant cavity which contains the lamp and a device for matching the cavity impedance to the source and transmission line. An example of a device according to this third method may be found in "Microwave Discharge Cavities Operating at 2450 MHz" by F. C. Fehsenfeld et al., Review of Scientific Instruments, Volume 36, Number 3, (March, 1965). Another example of a light source utilizing a resonant cavity is described in the U.S. Pat. No. 3,787,705 to Bolin.

All of these methods have disadvantages which limit their suitablility for use in a commercial light source such as a replacement for the conventional incandescent light bulb. An electrodeless lamp undergoes a large variation of impedance from the starting to the running conditions; at starting, the impedance is a lossy open circuit, while during the running condition, the lamp impedance is typically a few hundred ohms, having also a complex impedance component as well as a predominant real impedance component. For efficient operation, an electrodeless light source must have efficient power transfer from the source to the lamp regardless of the instantaneous lamp impedance. It would be highly advantageous to form a source of light that provides the proper impedance matching in an automatic fashion so that it could be used as a commercial light source.

SUMMARY OF THE INVENTION

The present invention relates to a light source of the type having a source of power at a high frequency, an electrodeless lamp being filled with a volatile fill material which emits light during excitation and breakdown and a termination fixture having an inner and outer conductor, the conductors having one end receiving power from the source and another end coupling power to the lamp. Accordingly, the termination fixture is designed so as to have a characteristic impedance which uniformly and dynamically varies so as to match the variable lamp impedance during the interval from starting to excitation and breakdown to the constant output impedance of the source. Preferably, the relative orientation of the conductors with respect to each other varies dynamically in response to the operating state of the lamp, thereby altering the characteristic impedance of the fixture. More specifically, the inner conductor has a relatively concentric orientation with respect to the outer conductor prior to start-up, thereby providing the fixture with a large characteristic impedance which is consistent with the large lamp impedance at starting. The inner conductor is made of a material having a non-uniform coefficient of thermal expansion such that after lamp starting, the inner conductor in response to the heat in the fixture becomes eccentric with respect to the outer conductor, thereby lowering the characteristic impedance of the fixture.

GENERAL CONSIDERATIONS

The present invention relates to a new technique of tuning a termination fixture for electrodeless lamps by the use of a center or inner conductor which is not constrained to a coaxial position with respect to the outer conductor. As used herein, tuning is used to refer to matching the impedance of the lamp to the output impedance of the power source. Pending patent applications and issued patents, which are assigned to the same assignee as in the present patent application, describe other tuning techniques. For example, U.S. Pat. application Ser. No. 570,113, filed Apr. 21, 1975 describes the use of an external tuning element. U.S. Pat. application Ser. No. 570,112, filed Apr. 21, 1975 describes the use of a fixed characteristic impedance line which is one-fourth wavelength long. Also, U.S. Pat. application Ser. No. 570,111, filed Apr. 21, 1975, now U.S. Pat. No. 3,943,401, describes the use of a triaxial switch which allows the characteristic impedance of the termination fixture to have two discrete values, one for starting and then one for operation. U.S. Pat. application Ser. No. 570,110 filed Apr. 21, 1975, now U.S. Pat. No. 3,943,404, describes the use of a helical center conductor. And lastly, U.S. Pat. application Ser. No. 570,055, filed Apr. 21, 1975, now U.S. Pat. No. 3,943,402, describes the use of a variable diameter center conductor. All of these techniques are useful in the development of a commercially feasible electrodeless light source. The present invention provides an enhanced degree of flexibility and capability for simple, fine tuning or for matching or tuning the lamp impedance to the output impedance of the source.

DESCRIPTION OF PREFERRED EMBODIMENT

Figure 1:
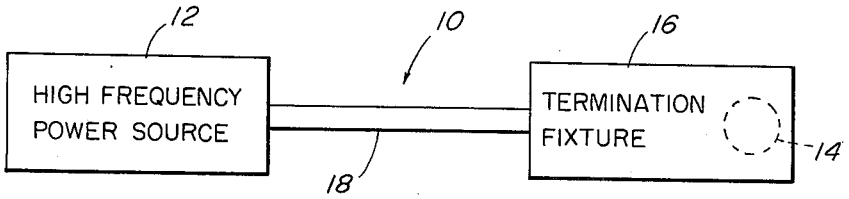
FIG. 1 is a block diagram of the electrodeless light source according to the invention.
Figure 2:
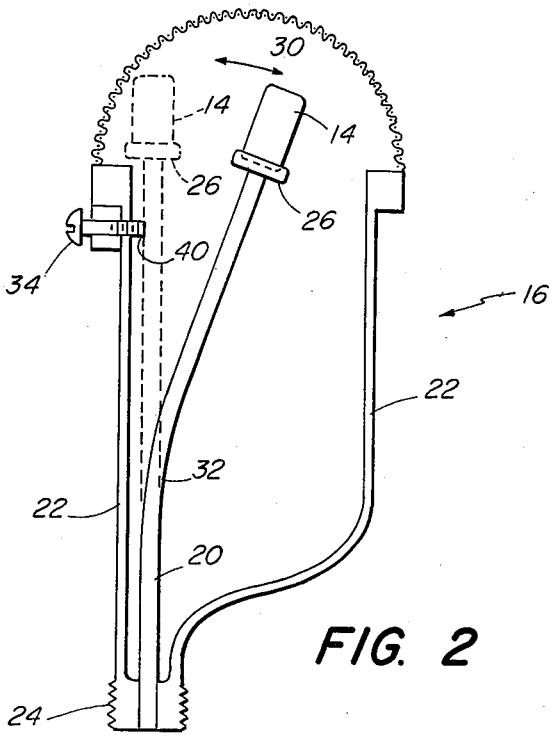
FIG. 2 is a sectional view of a termination fixture according to the invention having an eccentric inner conductor according to the invention.

In an exemplary embodiment of the present invention, as shown in FIG. 1, a light source indicated by the reference numeral 10, includes a source 12 of power at a high frequency, an electrodeless lamp 14 and a termination fixture 16 coupled to the source, such as by a transmission cable 18. As used herein, the phrase "high frequency" is intended to include frequencies in the range generally from 10 MHz to 300 GHz. Preferably, the frequency is an ISM band (i.e., industrial, scientific and medical band) one of which ranges from 902 MHz to 928 MHz. In the embodiment of FIG. 2, the frequency used was 915 MHz. One of many commercially available power sources which may be used is an Airborne Instruments Laboratory Power Signal Source, type 125. The lamp 14 has an envelope made of a light transmitting substance, such as quartz. The envelope encloses a volatile fill material which emits light upon breakdown and excitation. The following are specific examples of lamps and fill materials which may be used.

EXAMPLE I

| | |
|---|---|
| Fill Material | 9.1 mg. of mercury<br>10 torr of argon |
| Envelope | Quartz sphere having a 15 mm. ID |

EXAMPLE II

| | |
|---|---|
| Fill Material | 8.9 mg. of mercury<br>1.5 mg. of $ScI_3$<br>1.7 mg. NaI<br>20 torr of argon |
| Envelope | Quartz sphere having a 15 mm. ID |

EXAMPLE III

Another fill material is 2 or 3 atoms of sodium for each mercury atom to yield under operating conditions 200 torr sodium partial pressure and about 1,000 torr mercury partial pressure. The envelope is a material which is resistant to sodium such as translucent $Al_2O_3$.

Figure 3:
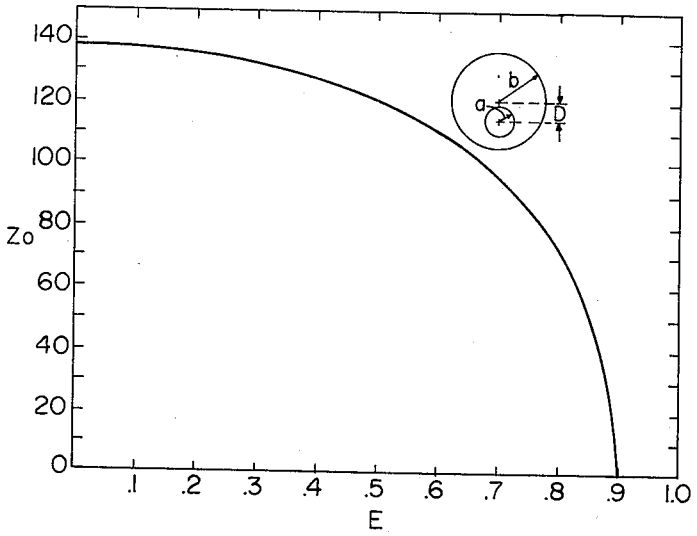
FIG. 3 is a graph illustrating characteristic impedance of the fixture as a function of the degree of eccentricity of the inner conductor with respect to the outer conductor.

Referring now to FIG. 2, the termination fixture 16 has an inner conductor 20 and an outer conductor 22. The conductors 20 and 22 have a first end 24 which is adapted to be coupled to the high frequency power source 12. The inner conductor 20 has a second end 26 which is in contact with the electrodeless lamp 14. In accordance with the invention, the fixture 16 includes the capability for uniformly and dynamically varying its characteristic impedance to match the lamp impedance to the output impedance of the source from lamp starting through breakdown and excitation. In the present invention this change in characteristic impedance is accomplished by changing in a controlled manner the separation of at least a portion of the inner conductor and the outer conductor. The characteristic impedance of an eccentric section of a bicylindrical line is given in the expression $$Z_o = \frac{60\Omega}{\sqrt{\epsilon}} \cosh -1 \left[ \frac{b}{2a}(1-E^2) + a/2b \right]$$

where E is a dimensionless quantity equal to D/b, D being the displacement of the axis of the inner cylinder of radius $a$ from the axis of the outer cylinder and $b$ being the radius of the outer cylinder. $\epsilon$ is the dielectric constant of the medium. A plot of $Z_o$ as a function of $E$ for b/a = 10 is shown in FIG. 3 for an air filled line (i.e., $\epsilon = 1$). It may be observed that the characteristic impedance may be varied between 138Ω and a very low impedance. It is this wide range that can provide in an eccentric termination device the flexibility of starting and operating several lamp types in a single fixture.

In an exemplary embodiment of the invention, control of inner and outer conductor separation is obtained by the combined effects of heat generated in the termination fixture and of movement of materials having a non-uniform coefficient of thermal expansion. The inner conductor 20 is formed of a material having a non-uniform coefficient of thermal expansion across its cross section along at least a portion of the length of the inner conductor 20. In the exemplary embodiment, the inner conductor is made of a pair of strips of metals which are secured together. The two metals, such as nickel and brass, have different coefficients of thermal expansion. Therefore, the inner conductor 20 undergoes a transverse movement represented generally by the arrow 30 in response to changes in temperature. The first end 24 of the inner conductor is mounted in the fixture eccentrically with respect to the outer conductor 22. This is accomplished by forming the outer conductor in an outwardly flaring manner as shown at 33 in FIG. 2. Between the first end 24 and the second end 26 of the inner conductor 20, there is formed therein a bend, such as at 32, so that the second end 26 is positioned generally concentrically with respect to the outer conductor. In this configuration, the fixture 16 has a maximum characteristic impedance. In operation, the inner conductor 20 becomes substantially straight in response to the heat generated in the termination fixture 16, thereby decreasing the characteristic impedance. The dotted lines for the inner conductor in the lamp in FIG. 2 represent the orientation of the inner conductor during the operating mode which is after breakdown and excitation of the lamp fill material.

Preferably, the termination fixture 16 also includes a device for fixing the maximum degree of eccentricity of the inner conductor with respect to the outer conductor 22. In one form of this device, an adjustable element, such as a threaded screw 34 is aligned through an aperture in the outer conductor 22 such that the end 40 of the device contacts the inner conductor 20 to limit its movement in response to heat. Preferably, the end of the screw 34 is made of a non-conductive material, such as a ceramic material so that the outer conductor 22 is electrically insulated from the inner conductor.

The following describes in more detail the operation of the termination fixture according to the present invention. When the lamp 14 is cold, the bimetallic center conductor 32 is bent so that the lamp is placed very near to the center of the termination fixture 16. In this position, the characteristic impedance at the lamp is large and the electric field strengths are also large, facilitating starting of the electrodeless lamp. As the lamp begins to warm up after starting, the bimetallic center conductor's temperature changes causing it to straighten itself until it presses against the ceramic tipped screw which is positioned to limit the travel of the center conductor. The screw allows one to tune to the running impedance of a particular lamp. Once set, this adjustment need not be changed unless the lamp is changed.

The embodiment of the present invention is intended to be merely exemplary and those skilled in the art shall be able to make numerous variations and modifications of it without departing from the spirit and scope of the present invention. The scope of this invention is not limited to the specific configuration described here. In fact, this concept may be used in more conventional termination fixtures for electrodeless lamps as an aid to fine tuning and to make them more versatile. Further, the shape of the outer conductor may be varied to make a smooth transition in characteristic impedance to reduce losses, and the use of bimetallic components or adjustable positioning devices is not necessary. The principle of controlled eccentricity of the conductors may be utilized by dynamically changing the shape of at least a portion of the outer conductor with respect to the inner conductor whose orientation is fixed. For example, the conductors could be formed as square or rectangular in shape and one or more sides of the outer conductor could be made moveable with respect to the inner conductor. More specifically, in one example, the outer conductor comprises a generally U-shaped member and a section mounted within the opening in the member in a manner so as to be capable of movement therebetween to produce controlled eccentricity. In another example, the outer conductor may be formed of two pairs of sections, each defining two sides of a square outer conductor. The sections are in moveable electrical contact. All such variations and modifications are intended to be within the scope of the present invention as defined by the appended claims.

We claim:

1. A light source including:

a. a source of power at a high frequency, b. an electrodeless lamp having an envelope made of a light transmitting substance, the envelope enclosing a volatile fill material which emits light upon breakdown and excitation, the lamp having an impedance that decreases from a higher level prior to breakdown and excitation to a lower level during excitation and breakdown; and c. a termination fixture having an inner conductor and an outer conductor disposed around the inner conductor, the conductors, having a first end coupled to the source and the inner conductor having a second end in contact with the lamp, the fixture further including dynamically variable characteristic impedance means to match the lamp impedance to the output impedance of the source as the lamp undergoes a variation in impedance level, wherein the variable characteristic impedance means includes means for dynamically changing the separation of the inner and outer conductors thereby changing the characteristic impedance of the termination fixture, wherein the means for changing the conductor separation includes thermal expansion means for changing the relative position of one of the conductors in response to heat generated within the termination fixture when the lamp is provided high frequency power.

2. The light source according to claim 1, wherein the thermal expansion means includes the inner conductor being formed of a material having a non-uniform coefficient of thermal expansion across the cross section of the conductor along at least a portion of the length of the inner conductor so that a portion of the inner conductor undergoes a traverse movement in the direction toward the outer conductor in response to changes in temperature.

3. The light source according to claim 2 further including:

a. the first end of the inner conductor being mounted in the fixture eccentrically with respect to the outer conductor, and b. the inner conductor between the first and second ends being formed with a bend so that the second end of the inner conductor and the lamp are positioned concentrically with respect to the outer conductor to provide the fixture with a maximum characteristic impedance, the inner conductor becoming substantially straight and eccentric in response to the heat to decrease the characteristic impedance after the lamp undergoes breakdown and excitation.

4. The light source according to claim 3 further including variable stop means for determining the maximum eccentricity of the inner conductor.

5. The light source according to claim 4, wherein the stop means includes:

a. an adjustable element positioned in an aperture formed in the outer conductor in the path of movement of the inner conductor, the element end being made of a non-conductive material and adapted to contact the inner conductor to inhibit further eccentric movement of the inner conductor.

6. The light source according to claim 5, wherein the adjustable element is threaded and engages threads in the aperture of the outer conductor or otherwise mounted to control the extent of the transverse motion of the end of the adjustable element in the fixture.

7. The light source according to claim 5, wherein the end of the adjustable element is made of a ceramic material.

* * * * *